US008757783B2

(12) United States Patent
Govyadinov et al.

(10) Patent No.: US 8,757,783 B2
(45) Date of Patent: Jun. 24, 2014

(54) FLUID EJECTION ASSEMBLY WITH CIRCULATION PUMP

(75) Inventors: Alexander Govyadinov, Corvallis, OR (US); Erik D. Torniainen, Albany, OR (US); Robert Messenger, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/703,371

(22) PCT Filed: Jul. 28, 2010

(86) PCT No.: PCT/US2010/043480

§ 371 (c)(1),
(2), (4) Date: Dec. 11, 2012

(87) PCT Pub. No.: WO2012/015397

PCT Pub. Date: Feb. 2, 2012

(65) Prior Publication Data

US 2013/0083136 A1 Apr. 4, 2013

(51) Int. Cl.
*B41J 2/175* (2006.01)
*B41J 2/14* (2006.01)

(52) U.S. Cl.
CPC .... *B41J 2/17596* (2013.01); *B41J 2002/14467* (2013.01); *B41J 2/1404* (2013.01); *B41J 2/1753* (2013.01); *B41J 2/14145* (2013.01); *B41J 2002/14387* (2013.01)
USPC ..... 347/85; 347/67

(58) Field of Classification Search
CPC ..... B41J 2/14056
USPC ..... 347/85, 67
See application file for complete search history.

(56) References Cited

U.S. PATENT DOCUMENTS

| | | | | |
|---|---|---|---|---|
| 5,818,485 | A | 10/1998 | Rezanka | |
| 6,055,002 | A | 4/2000 | Wen et al. | |
| 6,152,559 | A | 11/2000 | Kojima | |
| 6,244,694 | B1 | 6/2001 | Weber et al. | |
| 6,283,718 | B1 | 9/2001 | Prosperetti et al. | |
| 6,655,924 | B2 | 12/2003 | Ma | |
| 6,910,797 | B2 | 6/2005 | Falcon | |
| 7,049,558 | B2 | 5/2006 | Baer et al. | |
| 7,470,004 | B2 * | 12/2008 | Eguchi et al. | 347/65 |
| 2008/0055378 | A1 | 3/2008 | Drury et al. | |
| 2008/0143793 | A1 * | 6/2008 | Okuda | 347/68 |
| 2009/0040257 | A1 | 2/2009 | Bergstedt et al. | |

FOREIGN PATENT DOCUMENTS

| | | |
|---|---|---|
| JP | 10175307 | 6/1998 |
| JP | 2001205810 | 7/2001 |
| JP | 2004249741 | 9/2004 |

* cited by examiner

*Primary Examiner* — Stephen Meier
*Assistant Examiner* — Alexander D Shenderov
(74) *Attorney, Agent, or Firm* — Nathan R. Rieth

(57) ABSTRACT

A fluid ejection assembly includes a fluid slot formed in a first substrate and a channel formed in a chamber layer disposed on top of a second substrate. The bottom surface of the second substrate is adhered to the top surface of the first substrate and fluid feed holes are formed between the fluid slot and the channel. A fluid ejection element is at a first end of the channel and a pump element is at a second end of the channel to circulate fluid horizontally through the channel and vertically through the fluid feed holes.

12 Claims, 9 Drawing Sheets

FLUID EJECTION ASSEMBLY WITH CIRCULATION PUMP

BACKGROUND

Fluid ejection devices in inkjet printers provide drop-on-demand ejection of fluid droplets. In general, inkjet printers print images by ejecting ink droplets through a plurality of nozzles onto a print medium, such as a sheet of paper. The nozzles are typically arranged in one or more arrays, such that properly sequenced ejection of ink droplets from the nozzles causes characters or other images to be printed on the print medium as the printhead and the print medium move relative to each other. In a specific example, a thermal inkjet printhead ejects droplets from a nozzle by passing electrical current through a heating element to generate heat and vaporize a small portion of the fluid within a firing chamber. In another example, a piezoelectric inkjet printhead uses a piezoelectric material actuator to generate pressure pulses that force fluid droplets out of a nozzle.

Although inkjet printers provide high print quality at reasonable cost, continued improvement relies on overcoming various challenges that remain in their development. For example, air bubbles are a continuing problem in inkjet printheads. During printing, air from the ink is released and forms bubbles that can migrate from the firing chamber to other locations in the printhead and cause problems such as blocking ink flow, degrading the print quality, causing partly full print cartridges to appear empty, and ink leaks. In addition, pigment-ink vehicle separation (PIVS) remains a problem when using pigment-based inks. Pigment-based inks are preferred in inkjet printing as they tend to be more durable and permanent than dye-based inks. However, during periods of storage or non-use, pigment particles can settle or crash out of the ink vehicle (i.e., PIVS) which can impede or completely block ink flow to the firing chambers and nozzles in the printhead. Other factors such as evaporation of water (for aqueous inks) and solvent (for non-aqueous inks) can also contribute to PIVS and/or increased ink viscosity and viscous plug formation which prevent immediate printing after periods of non-use.

BRIEF DESCRIPTION OF THE DRAWINGS

The present embodiments will now be described, by way of example, with reference to the accompanying drawings, in which.

DETAILED DESCRIPTION

Overview of Problem and Solution

Figure 1:
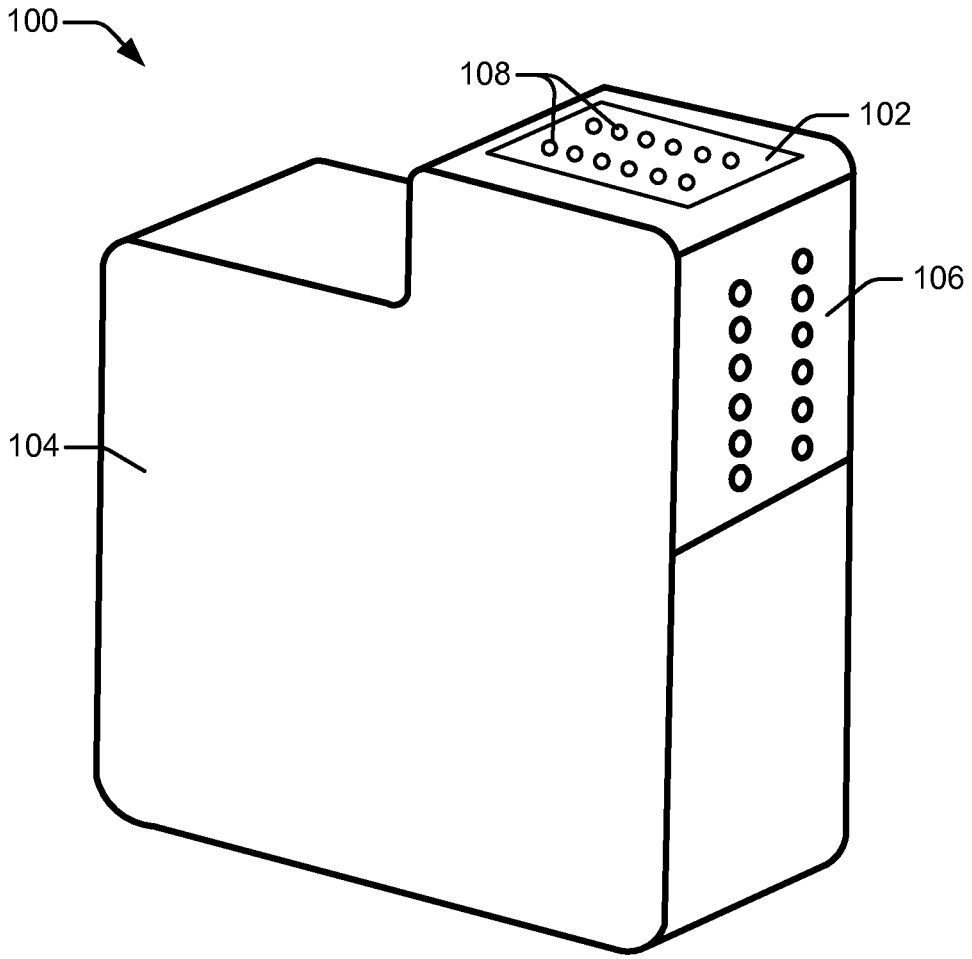
FIG. 1 shows an example of an inkjet pen suitable for incorporating a fluid ejection assembly, according to an embodiment.

As noted above, various challenges have yet to be overcome in the development of inkjet printing systems. For example, inkjet printheads used in such systems continue to have troubles with ink blockage and/or clogging. Previous solutions to this problem have primarily involved servicing the printheads before and after their use. For example, printheads are typically capped during non-use to prevent nozzles from clogging with dried ink. Prior to their use, nozzles are also primed by spitting ink through them. Drawbacks to these solutions include the inability to print immediately due to the servicing time, and an increase in the total cost of ownership due to the significant amount of ink consumed during servicing. Accordingly, ink blockage and/or clogging in inkjet printing systems remains a fundamental problem that can both degrade overall print quality and increase costs.

There are a number of causes for ink blockage or clogging in a printhead. One cause of ink blockage is an excess of air that accumulates as air bubbles in the printhead. When ink is exposed to air, such as while the ink is stored in an ink reservoir, additional air dissolves into the ink. The subsequent action of firing ink droplets from the firing chamber of the printhead releases excess air from the ink which then accumulates as air bubbles. The bubbles move from the firing chamber to other areas of the printhead where they can block the flow of ink to the printhead and within the printhead.

Pigment-based inks can also cause ink blockage or clogging in printheads. Inkjet printing systems use pigment-based inks and dye-based inks, and while there are advantages and disadvantages with both types of ink, pigment-based inks are generally preferred. In dye-based inks the dye particles are dissolved in liquid so the ink tends to soak deeper into the paper. This makes dye-based ink less efficient and it can reduce the image quality as the ink bleeds at the edges of the image. Pigment-based inks, by contrast, consist of an ink vehicle and high concentrations of insoluble pigment particles coated with a dispersant that enables the particles to remain suspended in the ink vehicle. This helps pigment inks stay more on the surface of the paper rather than soaking into the paper. Pigment ink is therefore more efficient than dye ink because less ink is needed to create the same color intensity in a printed image. Pigment inks also tend to be more durable and permanent than dye inks as they smear less than dye inks when they encounter water.

One drawback with pigment-based inks, however, is that ink blockage can occur in the inkjet printhead after shipping and prolonged storage, resulting in poor out-of-box performance of inkjet pens. Inkjet pens have a printhead affixed at one end that is internally coupled to a supply of ink. The ink supply may be self-contained within the pen body or it may reside on the printer outside of the pen and be coupled to the printhead through the pen body. Over long periods of storage, gravitational effects on the large pigment particles and/or degradation of the dispersant can cause pigment settling or crashing, which is known as PIVS (pigment-ink vehicle separation). The settling or crashing of pigment particles can impede or completely block ink flow to the firing chambers and nozzles in the printhead which can result in poor out-of-box performance by the printhead and reduced image quality.

Other factors such as evaporation of water and solvent from the ink can also contribute to PIVS and/or increased ink viscosity and viscous plug formation which prevent immediate printing after periods of non-use.

Embodiments of the present disclosure help to overcome the problem of ink blockage or clogging in inkjet printheads, generally through the use of a fluid ejection assembly having a fluid circulation pump. The pump is formed on a membrane over a fluid slot in an underlying substrate, and is asymmetrically located along the length of a fluid channel (i.e., toward one end of the channel) in order to create a directional fluid flow (i.e., fluidic diodicity). During idle time when the fluid ejection assembly is not operating, the pump circulates fluid horizontally through the fluid channel and a firing chamber (i.e., in the plane of the pump and firing chamer). The pump also simultaneously circulates fluid vertically through fluid feed holes formed between the channel and the fluid slot. During normal operation of the fluid ejection assembly, a fluid ejection element in the firing chamber ejects fluid droplets through a nozzle. The action of the fluid ejection element also creates a pumping action that circulates fluid horizontally through the channel and vertically between the channel and the fluid slot. The circulation of fluid during both idle time and active operation of the fluid ejection assembly helps to prevent ink blockage or clogging in inkjet printheads.

In one example embodiment, a fluid ejection assembly includes a fluid slot formed in a first substrate. The top surface of the first substrate is adhered to the bottom surface of a membrane, or second substrate. A channel is formed in a chamber layer disposed on top of the second substrate, and fluid feed holes are formed through the second substrate between the fluid slot and the channel. A fluid ejection element is located near a first end of the channel, and a pump element is located near a second end of the channel to circulate fluid horizontally through the channel and vertically through the fluid feed holes.

In another example embodiment, a fluid ejection assembly includes first and second substrates, with a top surface of the first substrate bonded to a bottom surface of the second substrate. A fluid slot is formed in the first substrate, and a chamber layer having a channel formed therein is disposed on a top surface of the second substrate. Fluid feed holes formed through the second substrate provides fluid communication between the fluid slot and the channel. An ejection element and pumping element are disposed in the channel to provide horizontal fluid circulation through the channel between the pumping element and the ejection element and vertical fluid circulation through the fluid feed holes between the channel and fluid slot.

In another example embodiment a method of circulating fluid in a fluid ejection assembly includes pumping fluid horizontally through a fluid channel between a pump element and an ejection element, and pumping fluid vertically between the fluid channel and a fluid slot through fluid feed holes that extend between the fluid channel and the fluid slot.

Illustrative Embodiments

FIG. 1 shows an example of an inkjet pen 100 suitable for incorporating a fluid ejection assembly 102 as disclosed herein, according to an embodiment. In this embodiment, the fluid ejection assembly 102 is disclosed as a fluid drop jetting printhead 102. The inkjet pen 100 includes a pen cartridge body 104, printhead (fluid ejection assembly) 102, and electrical contacts 106. Individual fluid drop generators 222 (e.g., see FIG. 2) in the fluid ejection assembly 102 are energized by electrical signals provided at contacts 106 to eject droplets of fluid from selected nozzles 108 and to circulate fluid within the assembly 102. Individual pumping elements 224 (e.g., see FIG. 2) in fluid ejection assembly 102 are also energized by electrical signals provided at contacts 106 to circulate fluid within the assembly 102. The fluid can be any suitable fluid used in a printing process, such as various printable fluids, inks, pre-treatment compositions, fixers, and the like. In some examples, the fluid can be a fluid other than a printing fluid. The pen 100 may contain its own fluid supply within cartridge body 104, or it may receive fluid from an external supply (not shown) such as a fluid reservoir connected to pen 100 through a tube, for example. Pens 100 containing their own fluid supplies are generally disposable once the fluid supply is depleted.

Figure 2A:
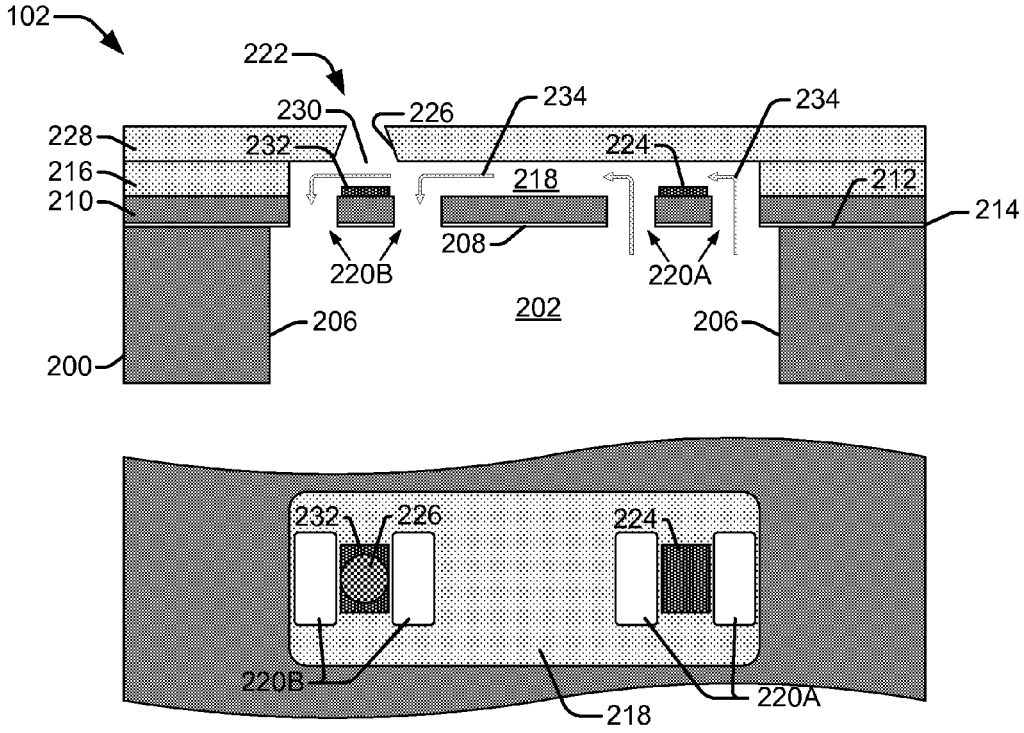
FIG. 2A shows a cross-sectional view and a top down view of a fluid ejection assembly, according to an embodiment.

FIG. 2A shows both a cross-sectional view and a top down view of a fluid ejection assembly 102 (printhead 102), according to an embodiment of the disclosure. Fluid ejection assembly 102 includes a first substrate 200 with a fluid slot 202 formed therein. The elongated fluid slot 202 extends into the plane of FIG. 2A and is in fluid communication with a fluid supply (not shown), such as a fluid reservoir. The fluid slot 202 is a trench formed in the first substrate 200 such that sidewalls 206 of the slot 202 are formed by the substrate 200. The top wall 208 of the fluid slot 202 is formed by a portion of the bottom surface of an overlying second substrate or membrane 210. The second substrate 210 is adhered by the remainder of its bottom surface 208 to the top surface 212 of the first substrate 200. The first and second substrates 200, 210, are formed from SOI (silicon on insulator) wafers in standard micro-fabrication processes that are well-known to those skilled in the art (e.g., electroforming, laser ablation, anisotropic etching, sputtering, dry etching, photolithography, casting, molding, stamping, and machining). Silicon dioxide (SiO2) layers 214 in the SOI substrates provide a mechanism for achieving accurate etch depths during fabrication while forming features such as the fluid slot 202.

A chamber layer 216 disposed on top of the second substrate 210 includes a fluid channel 218 formed within the layer 216. Fluid feed holes 220 (220A and 220B) extend through the second substrate 210 (which forms the top 208 of the fluid slot 202) and provide fluid communication between the fluid slot 202 and the fluid channel 218. The fluid channel 218 includes a drop generator 222 disposed toward one end of the channel 218 and a fluid pumping element 224 disposed toward the other end of the channel 218. The drop generator 210 includes a nozzle 226 formed in a nozzle plate 228 (or top hat layer), a firing chamber 230, and an ejection or firing element 232 disposed in the firing chamber 230. The firing chamber 230 is an extension of, and part of, the fluid channel 218. The firing chamber 230 and the fluid channel 218 widths can be specified independently to optimize fluid ejection and pumping. Ejection element 232 can be any device capable of operating to eject fluid drops through a corresponding nozzle 226, such as a thermal resistor or piezoelectric actuator. In the illustrated embodiment, ejection element 232 is a thermal resistor formed of a thin film stack applied on top of the second substrate 210. The thin film stack generally includes an oxide layer, a metal layer defining the ejection element 232, conductive traces, and a passivation layer (not individually shown).

Fluid pumping element 224 is also disposed on the top surface of the second substrate 210. Pump element 224 can be any device capable of operating to generate motion in the fluid and create fluid circulation as discussed herein, such as a thermal resistor. Although the pumping element 224 is discussed as a thermal resistor element, in other embodiments it can be any of various types of pumping elements that may be suitably deployed in a channel 218 of a fluid ejection assembly 102. For example, in different embodiments fluid pumping element 224 might be implemented as a piezoelectric actuator pump, an electrostatic pump, an electro hydrodynamic pump, or a peristaltic pump. In the illustrated embodiment, like ejection element 232, the pump element 224 is a thermal resistor formed of a thin film stack applied on top of the second substrate 210. In embodiments where the fluid pump 224 is a thermal resistor, a fluid pumping action is achieved by energizing the pump element 224 (i.e., thermal resistor) with an electrical current. The current causes the resistive pump element 224 to heat rapidly, which in turn superheats and vaporizes a thin layer of fluid in contact with the pump element 224. The expanding vapor bubble forces fluid away from the pump 224 in both directions within the channel 218. As discussed below, however, the asymmetric placement of the pump 224 with respect to the length or center of the channel 218 results in a net flow of fluid toward the long side of the channel 218.

The exact location of the fluid pumping element 224 within the fluid channel 218 may vary somewhat, but in any case will be asymmetrically located with respect to the center point of the length of the fluid channel 218. For example, assuming the length of a fluid channel 218 in FIG. 2A extends from the fluid feed hole 220B shown at the far left side of FIG. 2A to the fluid feed hole 220A at the far right side of FIG. 2A, then the approximate center of the channel 218 is located midway between these far left and far right fluid feed holes. Thus, the fluid pumping element 224 is located asymmetrically with respect to the center of the channel 218 toward the fluid feed hole 220A at the far right side of the channel 218. The asymmetric location of the fluid pumping element 224 creates a short side of the channel 218 between the pump 224 and the fluid slot 202, and a long side of the channel 218 that extends toward the center of the channel 218 and the drop generator 222.

The asymmetric location of the fluid pumping element 224 within the fluid channel 218 is the basis for a uni-directional flow of fluid (i.e., fluidic diodicity). The grey arrows 234 in FIG. 2A illustrate the general direction of fluid flow and fluid circulation created by the pumping action of the pumping element 224. The asymmetric placement of the pump 224 toward a short side of the channel 218 results in a net fluid flow in a direction toward the center or long side of the channel 218 (i.e., toward drop generator 222). As generally indicated by the grey directional arrows 234, the pumping element 224 circulates fluid vertically upward from the fluid slot 202 into the channel 218 through fluid feed holes 220A. The fluid is then pumped horizontally through the channel 218 toward drop generator 222 (i.e., in the plane of the pump 224 and ejection element 232/firing chamber 230), and then back into the fluid slot 202 in a vertical direction through fluid feed holes 220B.

Figure 2B:
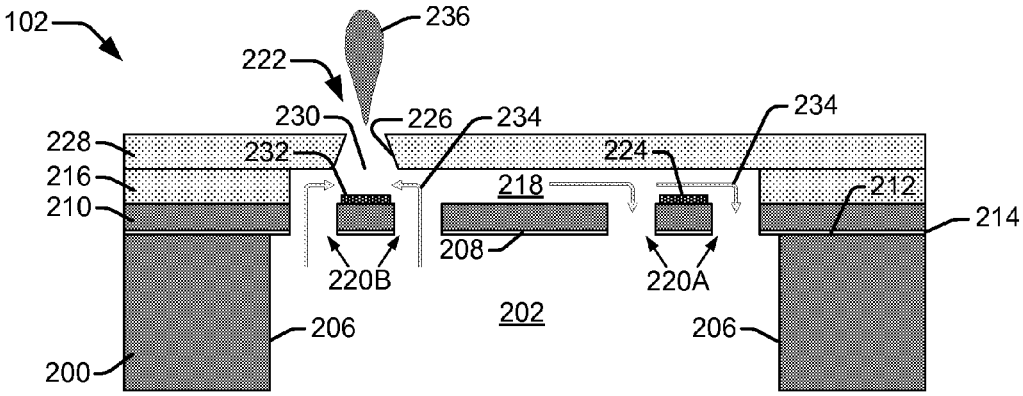
FIG. 2B shows a cross-sectional view of a fluid ejection assembly during a drop ejection event, according to an embodiment.

FIG. 2B shows a cross-sectional view of a fluid ejection assembly 102 during a drop ejection event, according to an embodiment of the disclosure. During normal operation of the fluid ejection assembly, a fluid droplet 236 is ejected from a chamber 230 through a corresponding nozzle 226 by activating a corresponding ejection element 232. The chamber 230 is then refilled with fluid circulating vertically upward from fluid slot 202 through fluid feed holes 220B in preparation for ejecting another fluid droplet. More specifically, electric current passed through the thermal resistor ejection element 232 results in rapid heating of the element 232, and a thin layer of fluid adjacent to the element 232 is superheated. The superheated fluid vaporizes, creating a vapor bubble in the corresponding firing chamber 230, and the rapidly expanding bubble forces a fluid droplet 236 out of the corresponding nozzle 226. When the ejection element 232 cools, the vapor bubble quickly collapses, drawing more fluid vertically upward through fluid feed holes 220B from fluid slot 202 and into the firing chamber 230 in preparation for ejecting another drop from the nozzle 226.

Thus, during normal drop ejection events it is apparent that the ejection element 232 acts in a dual capacity to eject fluid drops through nozzle 226 as well as circulate fluid within the fluid ejection assembly 102. The grey arrows 234 in FIG. 2B illustrate the general direction of fluid flow and fluid circulation created by the pumping action of the ejection element 232 during a drop ejection event. At first, as the rapidly expanding bubble forces a fluid droplet 236 out of the nozzle 226, fluid in channel 218 circulates horizontally away from the drop generator 222 toward the center or long side of the channel 218, in a manner similar to, but in the opposite direction of, that described above regarding the pumping element 224. As the vapor bubble collapses, fluid circulates vertically upward through fluid feed holes 220B into the chamber 230 and channel 218 to refill the void left by the ejected fluid drop 236. Thus, during fluid drop ejection, the ejection element 232 also acts as a pumping element to circulate fluid in both vertical and horizontal directions within the fluid ejection assembly 102, in much the same way as the pumping element 224. As noted above, the firing chamber 230 and the fluid channel 218 dimensions are independently specified to optimize both fluid ejection and pumping.

Figure 3:
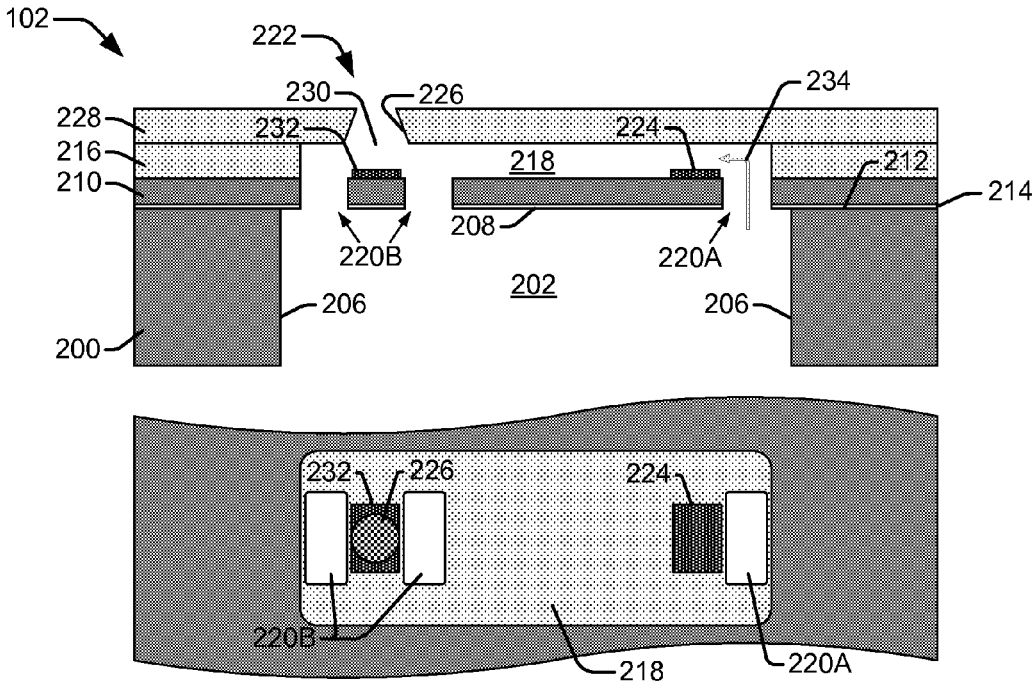
FIG. 3 shows a cross-sectional view and a top down view of a fluid ejection assembly having two fluid feed holes adjacent to either side of an ejection element and one fluid feed hole adjacent to the far side of a pumping element, according to an embodiment.

FIGS. 3-14 show varying views of a fluid ejection assembly 102 with variations in the structure and/or layout of the fluid channels 218, the fluid feed holes 220 that extend between the fluid slots 202 and channels 218, and the pumping elements 224 and ejection elements 232, according to embodiments of the disclosure. FIG. 3, for example shows a cross-sectional view and a top down view of a fluid ejection assembly 102 having two fluid feed holes 220B that are adjacent to either side of the ejection element 232 as in the FIG. 2 embodiment, but only one fluid feed hole 220A adjacent to the far side of the pumping element 224, according to an embodiment of the disclosure. As shown by the grey directional arrow 234, the pumping action of pump element 224 in the FIG. 3 embodiment circulates fluid vertically upward from the fluid slot 202 into the channel 218 through the single fluid feed hole 220A, and horizontally through the channel 218 toward the center or long side of the channel 218 (i.e., toward drop generator 222). Although not illustrated, during normal drop ejection events the ejection element 232 acts in a dual capacity to eject fluid drops through nozzle 226 as well as circulate fluid within the fluid ejection assembly 102. As in the FIG. 2 embodiment, the ejection element 232 circulates fluid in channel 218 horizontally away from the drop generator 222 toward the center or long side of the channel 218, and then vertically upward through fluid feed holes 220B into the chamber 230 and channel 218 to refill the void left by an ejected fluid drop 236 as the ejection element 232 cools and the vaporization bubble shrinks.

Figure 4:
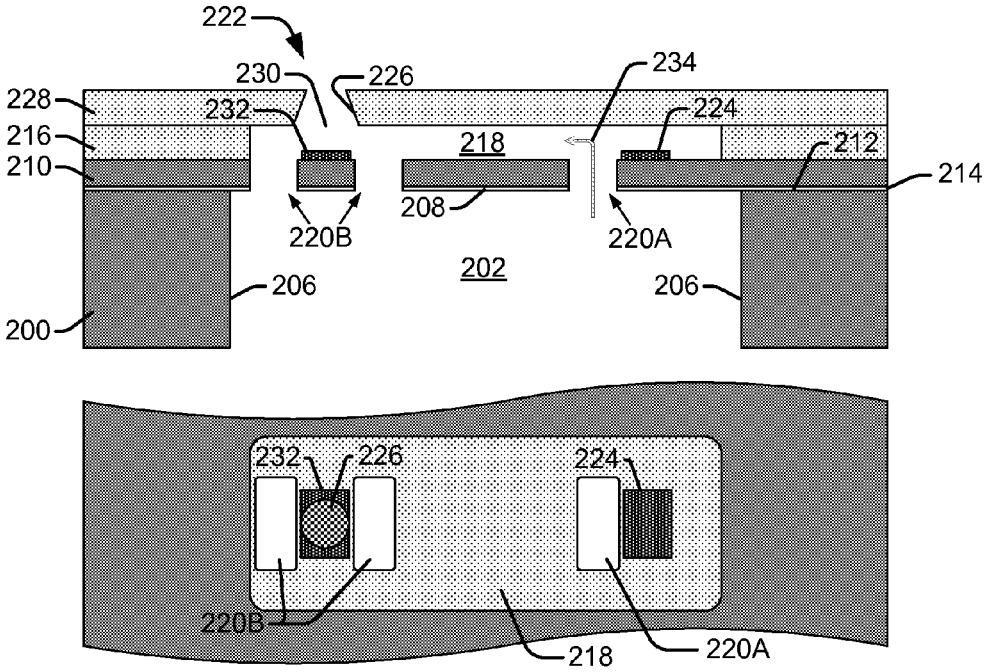
FIG. 4 shows a cross-sectional view and a top down view of a fluid ejection assembly having two fluid feed holes adjacent to either side of an ejection element and one fluid feed hole adjacent to the near side of a pumping element, according to an embodiment.
Figure 5:
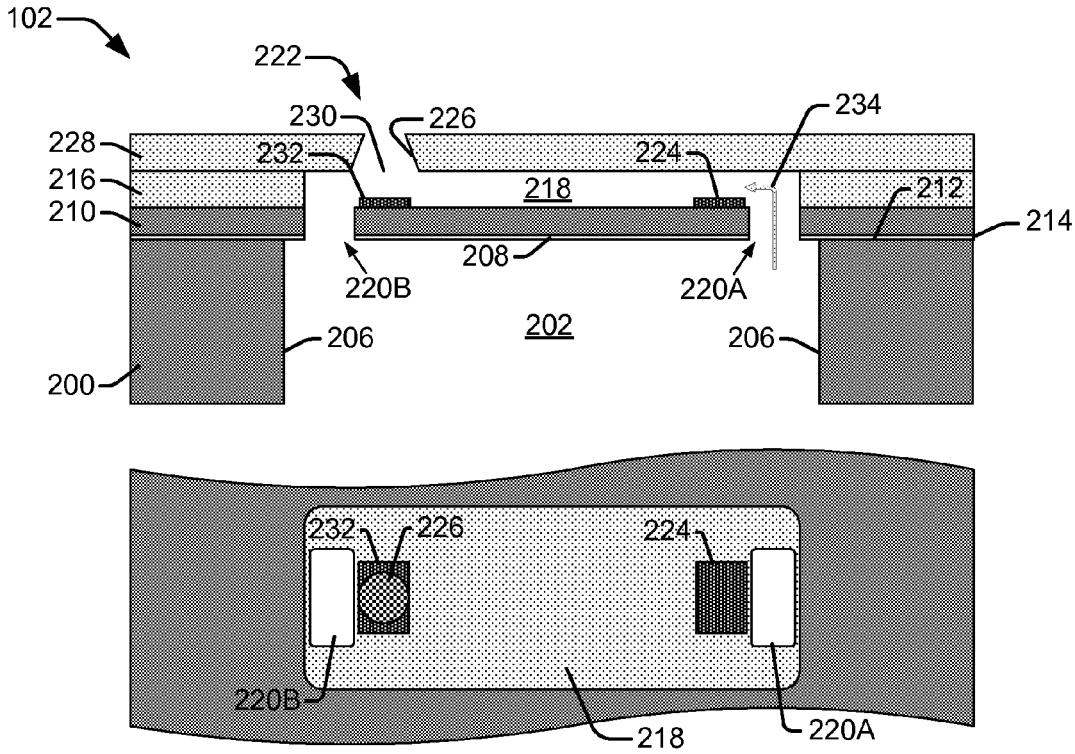
FIG. 5 shows a cross-sectional view and a top down view of a fluid ejection assembly having two fluid feed holes, one adjacent to a pump element and one adjacent to an ejection element and both at opposite ends of a fluid channel, according to an embodiment.
Figure 6:
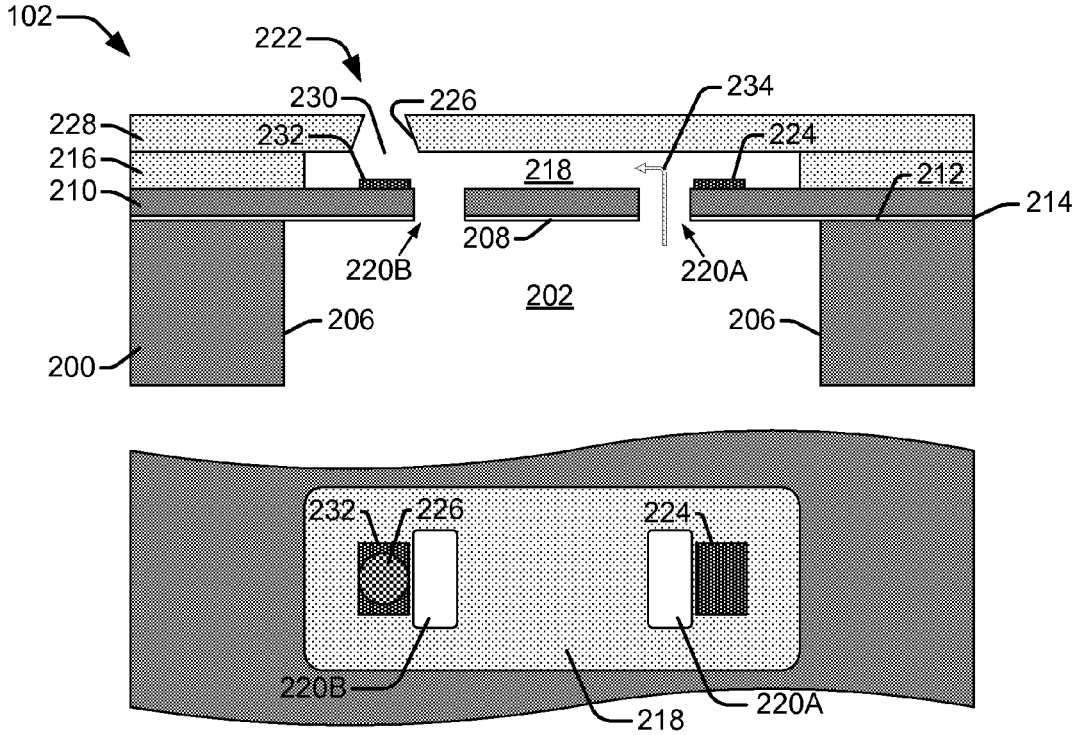
FIG. 6 shows a cross-sectional view and a top down view of a fluid ejection assembly having two fluid feed holes, one adjacent to a pump element and one adjacent to an ejection element and both toward the center of a fluid channel, according to an embodiment.

FIG. 4 shows a cross-sectional view and a top down view of a fluid ejection assembly 102 having two fluid feed holes 220B that are adjacent to either side of the ejection element 232 as in the FIG. 2 embodiment, but only one fluid feed hole 220A adjacent to the near side of pumping element 224, according to an embodiment of the disclosure. As shown by the grey directional arrow 234, the pumping action of pump element 224 in the FIG. 4 embodiment circulates fluid vertically upward from the fluid slot 202 into the channel 218 through the single fluid feed hole 220A, and horizontally through the channel 218 toward the center or long side of the channel 218 (i.e., toward drop generator 222). Again, during normal drop ejection events the ejection element 232 ejects fluid drops through nozzle 226 as well as circulates fluid within the fluid ejection assembly 102. The ejection element 232 circulates fluid in channel 218 horizontally away from the drop generator 222 toward the center or long side of the channel 218, and then vertically upward through fluid feed holes 220B into the chamber 230 and channel 218 to refill the void left by an ejected fluid drop 236.

Figure 7:
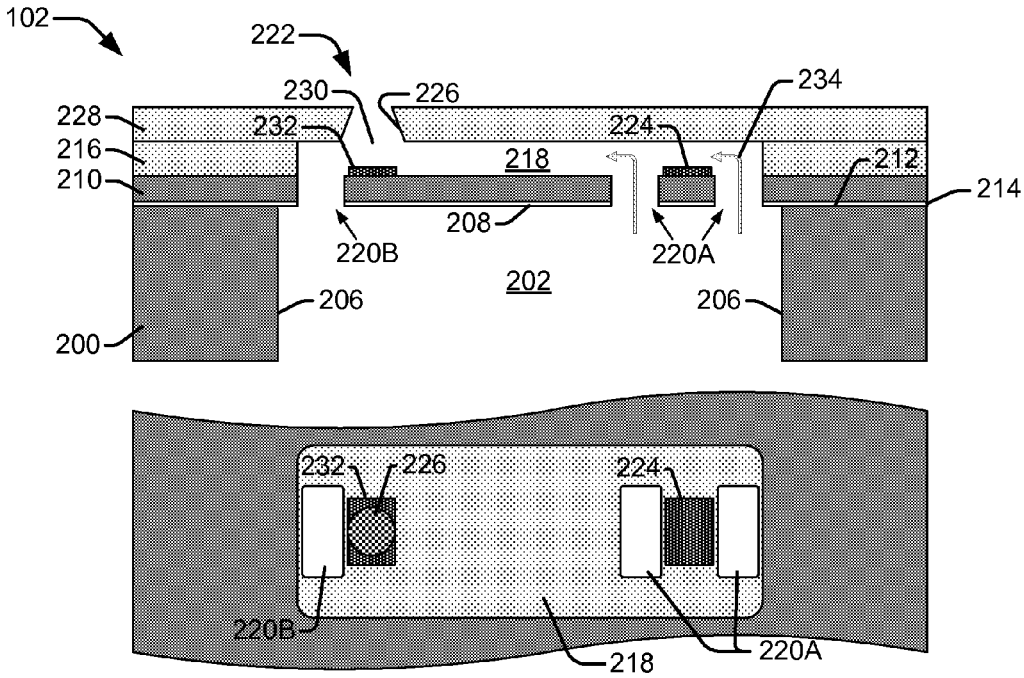
FIG. 7 shows a cross-sectional view and a top down view of a fluid ejection assembly having three fluid feed holes, two adjacent to a pump element and one adjacent to an ejection element at the far side of a fluid channel, according to an embodiment.
Figure 8:
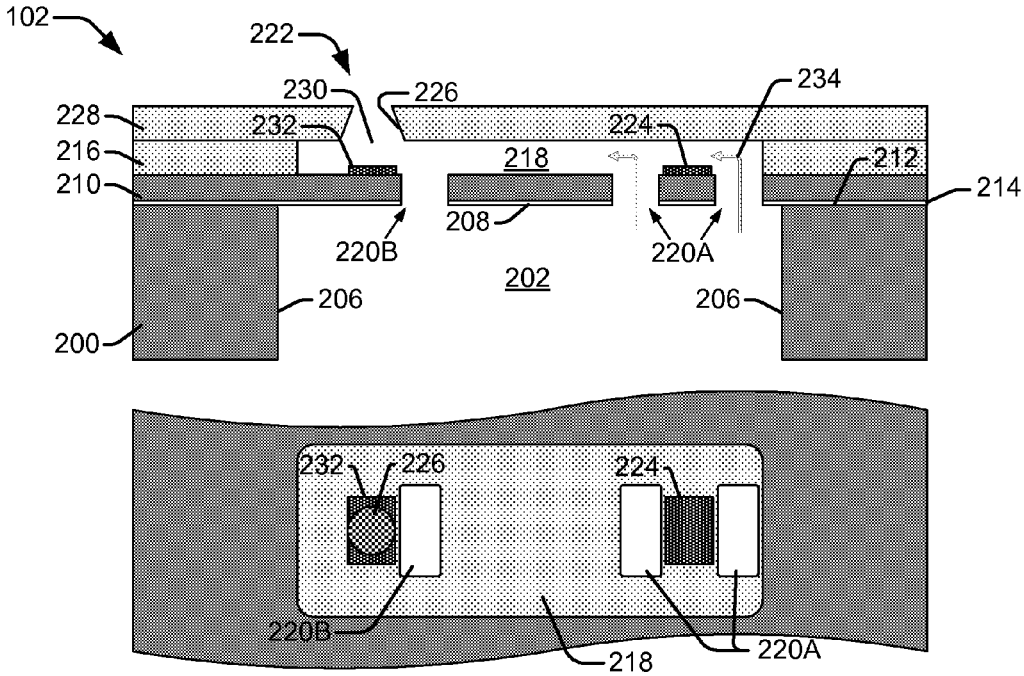
FIG. 8 shows a cross-sectional view and a top down view of a fluid ejection assembly having three fluid feed holes, two adjacent to a pump element and one adjacent to an ejection element toward the center of a fluid channel, according to an embodiment.

FIGS. 5-8 show additional example configurations of fluid channels 218, fluid feed holes, pumping elements 224 and ejection elements 232, within a fluid ejection assembly 102, and the general direction of fluid circulation generated by the respective pumping elements 224, according to embodiments of the disclosure. In the FIG. 5 embodiment, a fluid ejection assembly 102 has two fluid feed holes 220A and 220B, one adjacent to pumping element 224 and at the far right side of channel 218 and the other adjacent to ejection element 232 and at the far left side of channel 218. In the FIG. 6 embodiment, a fluid ejection assembly 102 also has two fluid feed holes 220A and 220B. One fluid feed hole 220A is adjacent to pumping element 224 and the other fluid feed hole 220B is adjacent to ejection element 232, and both are between the pumping element 224 and ejection element 232 toward the center of the channel 218. In the FIG. 7 and FIG. 8 embodiments, fluid ejection assemblies 102 have three fluid feed holes 220 with two fluid feed holes 220A adjacent to either side of the pumping element 224. In FIG. 7, the third fluid feed hole 220B is adjacent to the ejection element 232 at the far left side of channel 218, and in FIG. 8, the third fluid feed hole 220B is adjacent to the ejection element 232 toward the center of channel 218.

Figure 9:
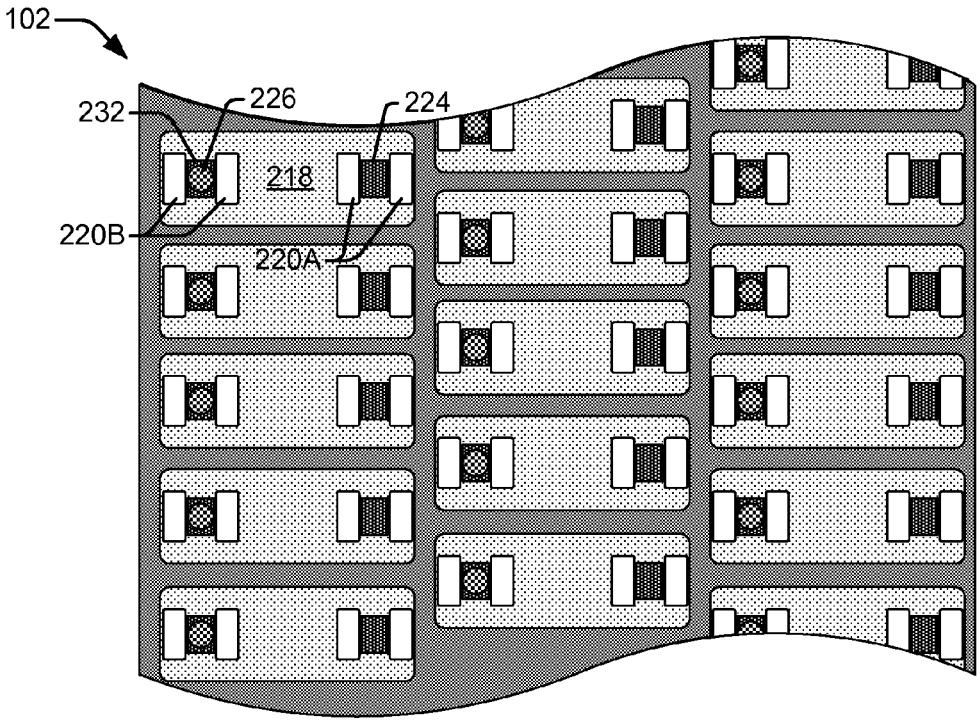
FIG. 9 shows a top down view of a fluid ejection assembly having pumping elements paired with ejection elements and fluid channels oriented orthogonally with respect to the length of the assembly, according to an embodiment.
Figure 10:
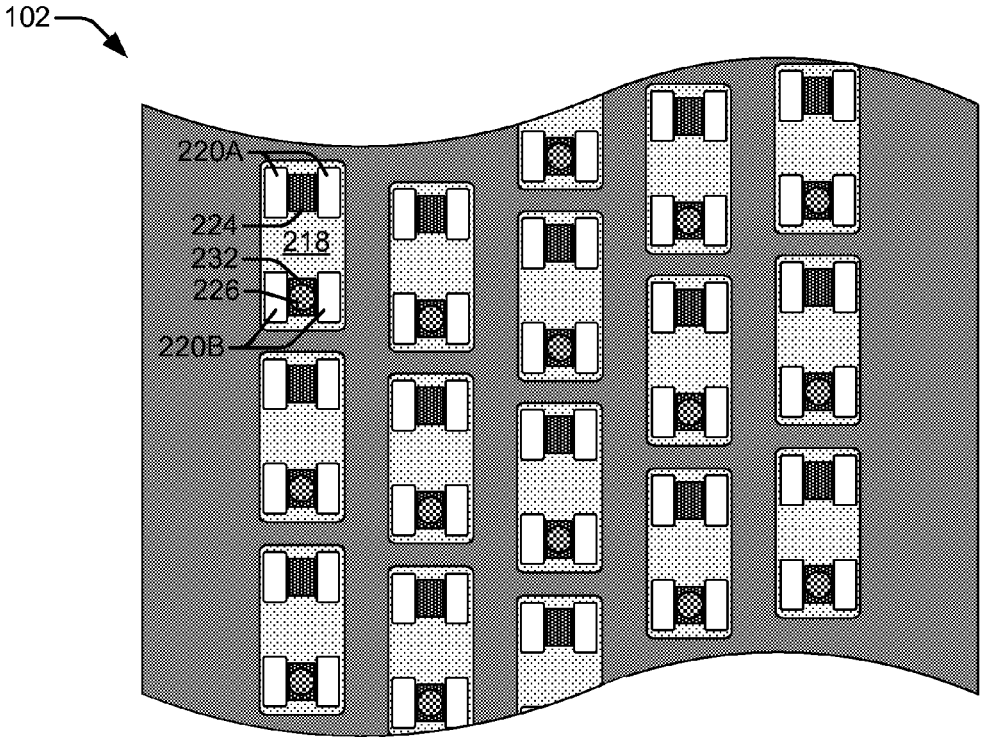
FIG. 10 shows a top down view of a fluid ejection assembly having pumping elements paired with ejection elements and fluid channels oriented length-wise with respect to the length of the assembly, according to an embodiment.

FIGS. 9 and 10 show top down views of fluid ejection assemblies 102 where pumping elements 224 are paired with ejection elements 232 within a fluid channel 218, according to embodiments of the disclosure. In the FIG. 9 embodiment, the lengths of the fluid channels 218 are oriented orthogonal to the length of the fluid ejection assembly 102 and underlying fluid slot 202 (not shown). In the FIG. 10 embodiment, the lengths of the fluid channels 218 are oriented such that they correspond with the length of the fluid ejection assembly 102 and underlying fluid slot 202 (not shown). In both cases, the asymmetric location of the pumping element 224 and ejection element 232 in each fluid channel 218 results in fluid circulation back and forth between the pumping element 224 and ejection element 232 and to and from the underlying fluid slot 202 through fluid feed holes 220. For example, in the FIG. 9 embodiment, pumping element 224 circulates fluid vertically upward (i.e., out of the plane) from the underlying fluid slot 202 through fluid feed holes 220A, then horizontally through the fluid channel 218 from the pumping element 224 to the ejection element 232 (i.e., within the plane of the pump element 224, ejection element 232, etc.), and vertically downward (i.e., into the plane) back into the fluid slot 202 through fluid feed holes 220B. When the ejection element 232 activates to eject fluid drops, the pumping effect of the ejection element 232 causes fluid to circulate mostly in a reverse direction. Fluid circulates in a similar manner in the FIG. 10 embodiment.

Figure 11:
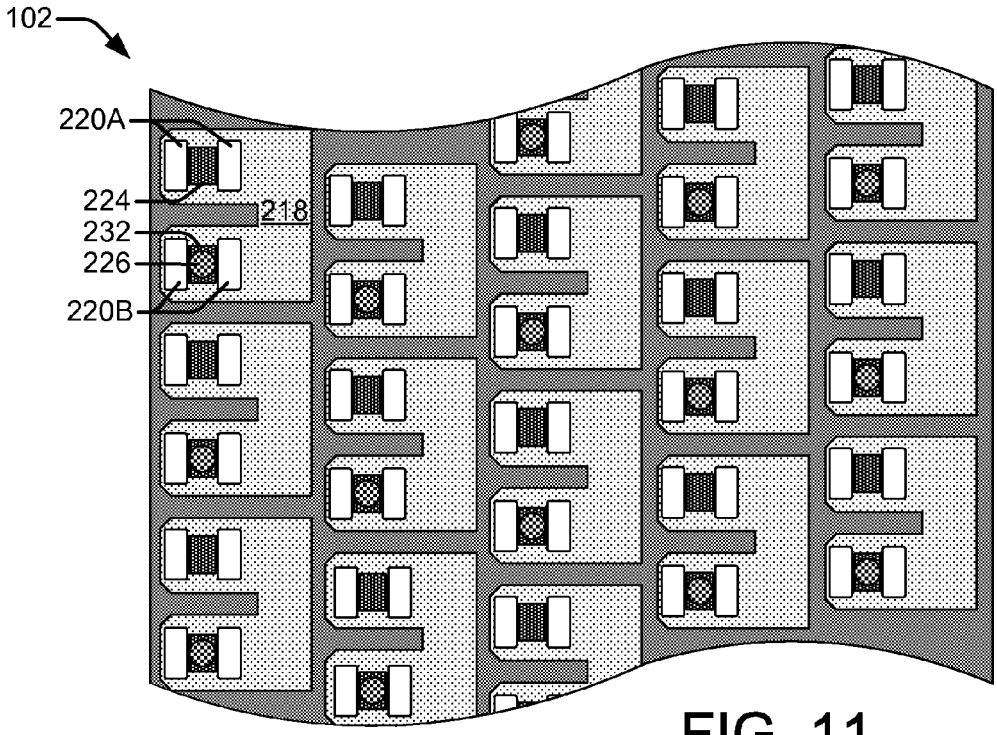
FIG. 11 shows a top down view of a fluid ejection assembly having pumping elements paired with ejection elements and u-shaped fluid channels, according to an embodiment.
Figure 12:
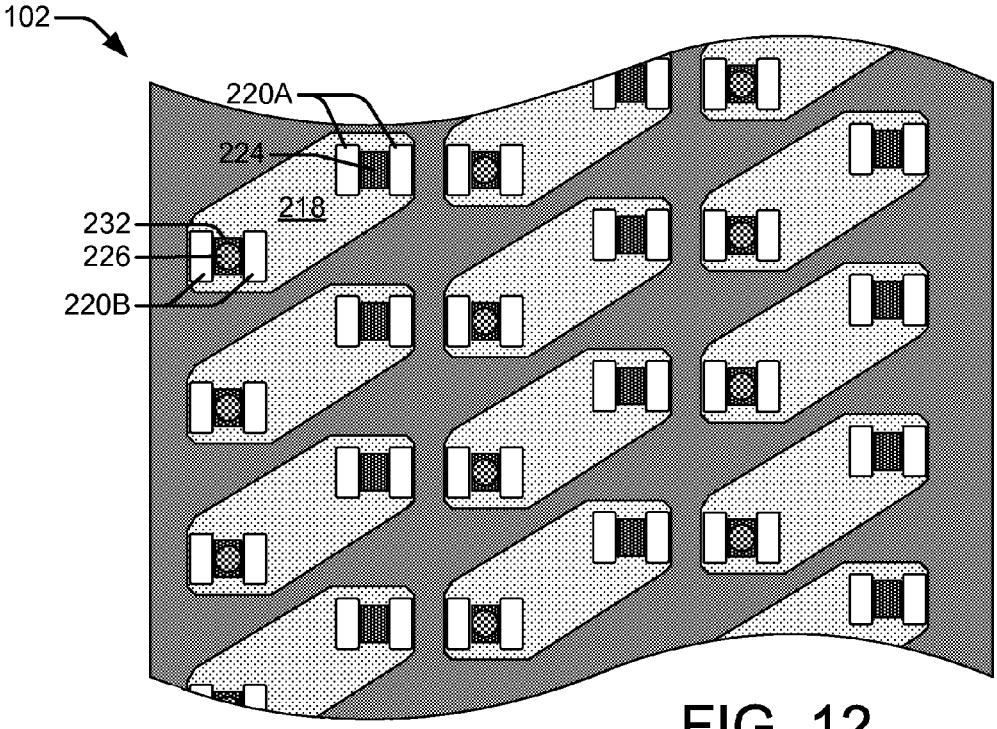
FIG. 12 shows a top down view of a fluid ejection assembly having pumping elements paired with ejection elements and fluid channels oriented diagonally with respect to the length of the fluid ejection assembly, according to an embodiment.

FIGS. 11 and 12 show top down views of fluid ejection assemblies 102 where pumping elements 224 are paired with ejection elements 232 within a fluid channels 218 having different shapes, according to embodiments of the disclosure. In the FIG. 11 embodiment, the fluid channels 218 are u-shaped with the pump element 224 and fluid feed holes 220A on one side of the "u", and the ejection element 232 and fluid feed holes 220B on the other side of the "u". The pumping element 224 circulates fluid vertically upward (i.e., out of the plane) from the underlying fluid slot 202 through fluid feed holes 220A, then horizontally through the u-shaped fluid channel 218 from the pumping element 224 to the ejection element 232 (i.e., within the plane of the pump element 224, ejection element 232, etc.), and vertically downward (i.e., into the plane) back into the fluid slot 202 through fluid feed holes 220B. When the ejection element 232 activates to eject fluid drops, the pumping effect of the ejection element 232 causes fluid to circulate mostly in a reverse direction. The FIG. 12 embodiment has fluid channels 218 that are oriented diagonally with respect to the length of the fluid ejection assembly 102 and underlying fluid ejection slot 202. Fluid circulation in the FIG. 12 embodiment is similar to the FIG. 11 embodiment.

Figure 13:
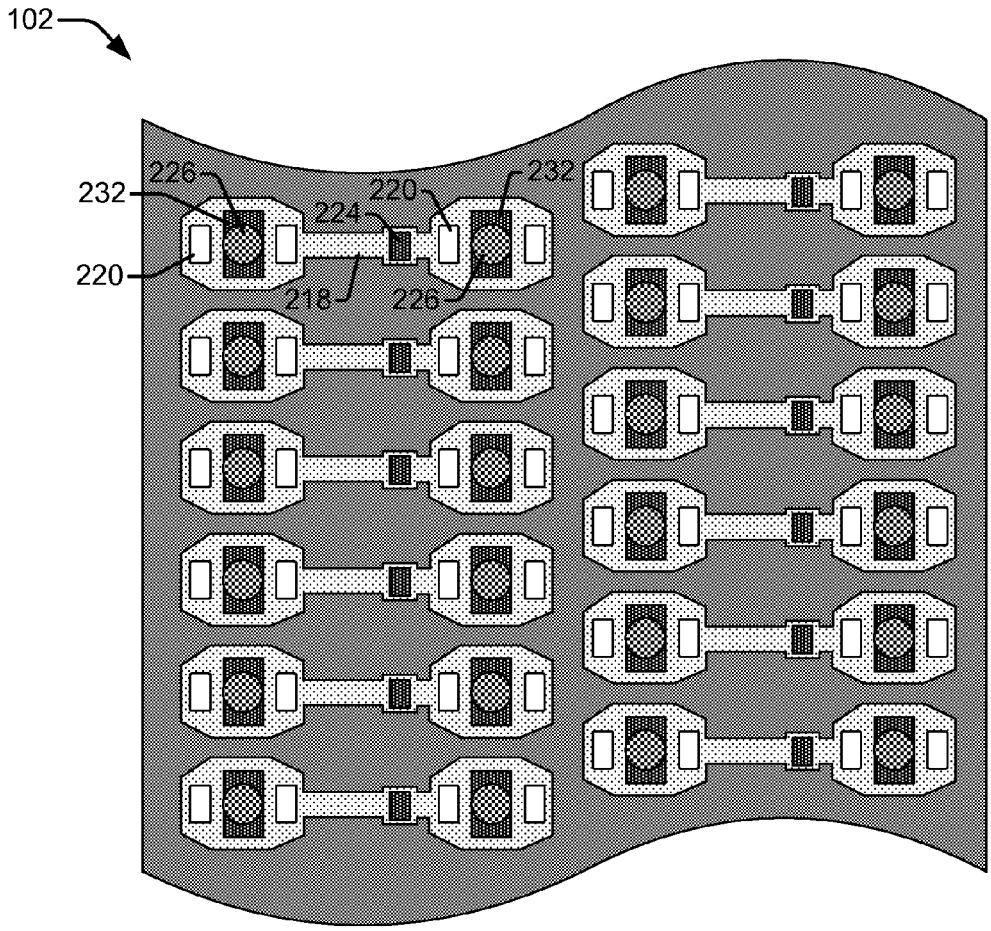
FIG. 13 shows a top down view of a fluid ejection assembly having paired drop generators with unbalanced circulation channels, according to an embodiment.

FIG. 13 shows a top down view of a fluid ejection assembly 102 having paired drop generators 222 with unbalanced circulation channels 218, according to an embodiment of the disclosure. As in previous embodiments, the asymmetric location of the fluid pumping element 224 within the fluid channel 218 is the basis for a uni-directional flow of fluid (i.e., fluidic diodicity). The asymmetric placement of the pump element 224 toward one end of the channel 218 results in a net flow of fluid toward the long side of the channel 218. Thus, in the FIG. 13 embodiment, pump element 224 operates to circulate fluid horizontally from right to left within channel 218 (i.e., within the plane of the pump 224, ejection element 232,etc.), and vertically upward (i.e., out of the plane) through the fluid feed holes 220 on the right side of the channel 218 and vertically downward (i.e., into the plane) through the fluid feed holes 220 on the left side of the channel 218.

Figure 14:
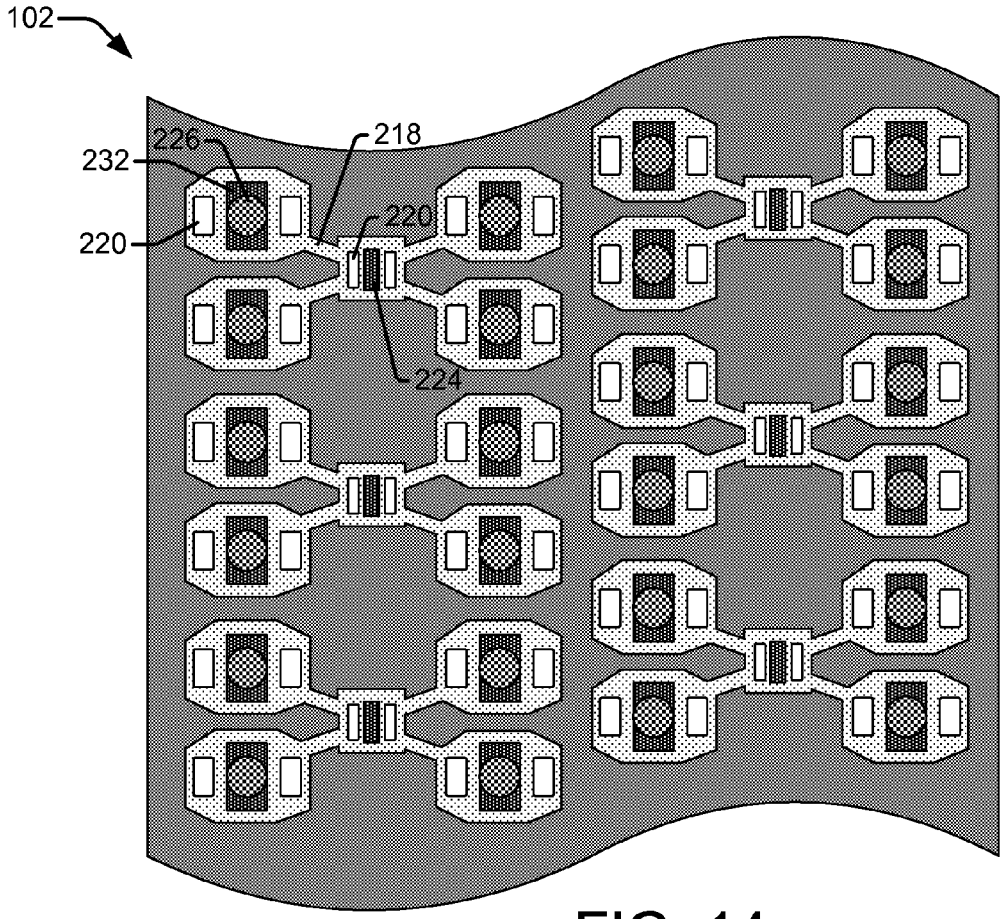
FIG. 14 shows a top down view of a fluid ejection assembly having a pumping element shared between a number of surrounding drop generators via circulation channels, according to an embodiment.

FIG. 14 shows a top down view of a fluid ejection assembly 102 having a pumping element shared between a number of surrounding drop generators 222 via circulation channels 218, according to an embodiment of the disclosure. The central location of the pumping element 224 between the four drop generators 222 results in fluid circulating vertically upward (i.e., out of the plane) through the fluid feed holes 220 adjacent to the pump 224, horizontally through the cannels 218 to each of the drop generators 222 (i.e., within the plane of the pump 224, ejection elements 232,etc.), and vertically downward (i.e., into the plane) through the fluid feed holes 220 on either side of the ejection elements 232.

Figure 15:
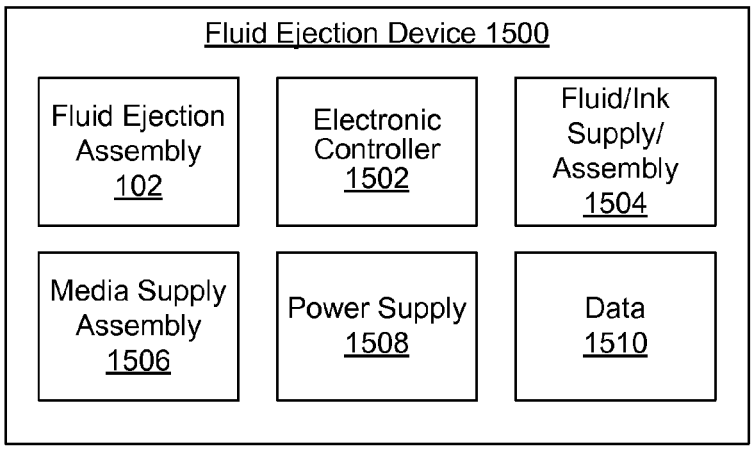
FIG. 15 shows a block diagram of a basic fluid ejection device, according to an embodiment of the disclosure.

FIG. 15 shows a block diagram of a basic fluid ejection device, according to an embodiment of the disclosure. The fluid ejection device 1500 includes an electronic controller 1502 and a fluid ejection assembly 102. Fluid ejection assembly 102 can be any embodiment of a fluid ejection assembly 102 described, illustrated and/or contemplated by the present disclosure. Electronic controller 1502 typically includes a processor, firmware, and other electronics for communicating with and controlling fluid ejection assembly 102 to eject fluid droplets in a precise manner.

In one embodiment, fluid ejection device 1500 may be an inkjet printing device. As such, fluid ejection device 1500 may also include a fluid/ink supply and assembly 1504 to supply fluid to fluid ejection assembly 102, a media transport assembly 1506 to provide media for receiving patterns of ejected fluid droplets, and a power supply 1508. In general, electronic controller 1502 receives data 1510 from a host system, such as a computer. The data 1510 represents, for example, a document and/or file to be printed and forms a print job that includes one or more print job commands and/or command parameters. From the data 1510, electronic controller 1002 defines a pattern of drops to eject which form characters, symbols, and/or other graphics or images.

What is claimed is:

1. A fluid ejection assembly comprising:
- a fluid slot formed in a first substrate;
- a chamber layer disposed on top of a second substrate, wherein a bottom surface of the second substrate is adhered to a top surface of the first substrate;
- a nozzle plate formed over the chamber layer;
- a channel formed in the chamber layer between the nozzle plate and second substrate;
- a fluid feed holes formed between the fluid slot and the channel;
- a fluid ejection element at a first end of the channel; and
- a pump element formed on the second substrate within the channel at a second end of the channel to circulate fluid horizontally through the channel and vertically through the fluid feed holes.

2. A fluid ejection assembly as in claim 1, wherein the fluid feed holes comprise:
- a first fluid feed hole adjacent to the fluid ejection element; and
- a second fluid feed hole adjacent to the pump element.

3. A fluid ejection assembly as in claim 2, wherein the first fluid feed hole is between the fluid ejection element and the first end of the channel.

4. A fluid ejection assembly as in claim 2, wherein the second fluid feed hole is between the pump element and the second end of the channel.

5. A fluid ejection assembly as in claim 1, wherein the fluid feed holes comprise:
- first and second fluid feed holes adjacent to and on either side of the fluid ejection element; and
- a third fluid feed hole adjacent to the pump element.

6. A fluid ejection assembly as in claim 1, wherein the fluid feed holes comprise:
- first and second fluid feed holes adjacent to and on either side of the pump element; and
- a third fluid feed hole adjacent to the fluid ejection element.

7. A fluid ejection assembly as in claim 1, wherein the fluid feed holes comprise:
- first and second fluid feed holes adjacent to and on either side of the fluid ejection element; and
- third and fourth fluid feed holes adjacent to and on either side of the pump element.

8. A fluid ejection assembly as in claim 1, wherein the channel is u-shaped.

9. A fluid ejection assembly as in claim 1, wherein the channel is diagonally oriented with respect to a long dimension of the fluid slot.

10. A fluid ejection assembly comprising:
- first and second substrates, a top surface of the first substrate bonded to a bottom surface of the second substrate;
- a fluid slot formed in the first substrate;
- a chamber layer formed on a top surface of the second substrate and having a channel defined therein;
- a nozzle plate formed over the chamber layer;
- fluid feed holes formed through the second substrate to provide fluid communication between the fluid slot and the channel;
- an ejection element disposed in the channel; and
- a pumping element formed on the second substrate within the channel to provide horizontal fluid circulation through the channel between the pumping element and the ejection element and vertical fluid circulation through the fluid feed holes between the channel and fluid slot.

11. A fluid ejection assembly as in claim 10, wherein the channel comprises multiple channels that intersect at a first end, and wherein the pumping element is disposed at the intersection of the channels and an ejection element is disposed at a second end of each channel, the pumping element to provide horizontal fluid circulation through the channels between the pumping element and each ejection element and vertical fluid circulation through the fluid feed holes between the channels and fluid slot.

12. A fluid ejection assembly as in claim 10, wherein the pumping element is located asymmetrically with respect to a central point along the channel.

* * * * *